US008487183B2

(12) United States Patent
Schulte et al.

(10) Patent No.: US 8,487,183 B2
(45) Date of Patent: Jul. 16, 2013

(54) CONTACT UNIT AND METHOD FOR PRODUCING A CONTACT UNIT

(75) Inventors: Hans-Hilmar Schulte, Scheider-Schwalenberg (DE); Christian Helmig, Detmold (DE); Ulrich Rosemeyer, Schieder Schwalenberg (DE)

(73) Assignee: Phoenix Contact GmbH & Co. KG, Blomberg (DE)

( * ) Notice: Subject to any disclaimer, the term of this patent is extended or adjusted under 35 U.S.C. 154(b) by 213 days.

(21) Appl. No.: 12/808,853

(22) PCT Filed: May 12, 2009

(86) PCT No.: PCT/EP2009/003365

§ 371 (c)(1),
(2), (4) Date: Aug. 5, 2010

(87) PCT Pub. No.: WO2009/141075

PCT Pub. Date: Nov. 26, 2009

(65) Prior Publication Data

US 2010/0314157 A1 Dec. 16, 2010

(30) Foreign Application Priority Data

May 19, 2008 (DE) ..... 10 2008 024 164
Sep. 23, 2008 (DE) ..... 10 2008 048 613

(51) Int. Cl.
*H01B 5/00* (2006.01)

(52) U.S. Cl.
USPC ..... 174/94 R; 174/126.2

(58) Field of Classification Search
USPC ..... 174/126.2, 94 R
See application file for complete search history.

(56) References Cited

U.S. PATENT DOCUMENTS

| | | | | | |
|---|---|---|---|---|---|
| 3,260,580 | A | * | 7/1966 | Kamm et al. | 428/648 |
| 3,331,912 | A | * | 7/1967 | Stricker et al. | 174/50.52 |
| 3,853,382 | A | * | 12/1974 | Lazar | 439/438 |
| 4,661,215 | A | * | 4/1987 | Diehl | 205/140 |
| 5,427,677 | A | * | 6/1995 | Mosher | 205/138 |
| 6,136,460 | A | * | 10/2000 | Chen et al. | 428/699 |
| 6,352,197 | B1 | * | 3/2002 | Mutaguchi | 228/180.5 |
| 2001/0018299 | A1 | | 8/2001 | Lin | |
| 2002/0187364 | A1 | | 12/2002 | Heber et al. | |
| 2006/0025024 | A1 | | 2/2006 | Yamagami et al. | |
| 2008/0261071 | A1 | | 10/2008 | Xu et al. | |

FOREIGN PATENT DOCUMENTS

| | | | | |
|---|---|---|---|---|
| DE | 198 02 580 | A1 | | 8/1999 |
| EP | 1 622 225 | A1 | | 2/2006 |
| JP | 11 214050 | A | | 8/1999 |
| WO | WO 99/06612 | | * | 2/1999 |
| WO | WO-2005/074026 | A2 | | 8/2005 |

* cited by examiner

*Primary Examiner* — Chau Nguyen
(74) *Attorney, Agent, or Firm* — Harness, Dickey & Pierce, P.L.C.

(57) ABSTRACT

The invention relates to a contact unit and particularly a solder pin, and a method for producing a contact unit, comprising a body having a metal core and a tin layer surrounding the metal core. The tin layer is thereby designed as a duplex layer, and comprises a radially inner layer overlay of matte tin and a radially outer layer overlay of glossy tin.

16 Claims, 1 Drawing Sheet

CONTACT UNIT AND METHOD FOR PRODUCING A CONTACT UNIT

CROSS-REFERENCE TO RELATED APPLICATIONS

This application is a National Stage of International Application No. PCT/EP2009/003365, filed May 12, 2009. This application claims the benefit and priority of German applications 10 2008 024 164.4, filed May 19, 2008, and 10 2008 048 613.2, filed Sep. 23, 2008. The entire disclosures of the above applications are incorporated herein by reference.

BACKGROUND

This section provides background information related to the present disclosure which is not necessarily prior art.

TECHNICAL FIELD

The present invention relates to a contact unit, particularly a solder pin, and a method for producing a contact unit, or a solder pin, wherein the body of the contact unit is surrounded by a tin layer.

DISCUSSION

Various contact units and solder pins are known from the prior art, using which a soldered connection to a conductor or a printed circuit board is practicable. For example, a solder pin with a body is known from DE 198 02 580 A1 wherein the body comprises a metal core of copper and a tin layer surrounding the metal core. In conventional soldering processes using solders containing lead, such solder pins can be used as solderable contact pins.

The conversion from electronics surface systems containing lead to lead-free surfaces results in increasing thermal stress on the surfaces of contact pins because of higher temperatures in the soldering processes. Because the melting point of the popularly used glossy tin surfaces is significantly exceeded, the result is bubbling on the surface of the contact pins that can be caused by the outgassing of organic components. Further, ablation of the tin surfaces often occurs as the result of which the contact pins are locally no longer furnished with a tin layer. Consequently, such contact pins can be soldered only poorly, or not at all, or they no longer meet mechanical requirements.

A similar set of problems arises when the contact pins or solder pins are produced using a thermal separation process. Dewetting occurs as a result of the increased temperatures, particularly at the pin tips on which no tin layer, or only a very thin layer, is present locally. This results in poor solderability of the contact pins. For this reason, the solder pins are galvanized over their entire surface in a downstream galvanizing bath after the thermal separation process. This can be carried out, for example, in drum galvanization in which a large number of contact pins in a drum are introduced into a galvanic bath. There the contact pins are given a tin layer in a galvanizing process. As a result of the subsequently applied tin layer, areas of the pins exposed during the separation process are prepared for the subsequent soldering process so that a gas-tight contact can be ensured in the contact area with respect to a connector. This additional process step brings about the desired result, but represents a substantial expense.

The disadvantage of the known method is the expense of production, which also increases the unit cost.

A potential solution would be to produce the contact pins by means of a different method in which the contact pin is not subjected to such high temperatures. However, since even in the soldering processes for reliably attaching contact pins on a printed circuit board, for example using modern soldering processes such as reflow soldering, temperatures of up to approximately 265 degrees Celsius are encountered; the contact pins are exposed to high temperatures at the latest at the time they are inserted, even with a different method of production, so that when soldering the contact pin to a printed circuit board such high temperatures can occur that dewetting of the tin layer on the contact pin occurs.

A further problem when working with lead-free tin solders is potential whisker formation. Whiskers can form in particular with components that were processed using lead-free tin solders. Tin whiskers, or whiskers in general, are thin, or needle-shaped, single crystals a few micrometers in diameter and up to several hundred micrometers in length that can grow from galvanically or pyrolytically deposited layers.

If whiskers break free as the result of vibration for example, or other mechanical stresses, they can cause short circuits on printed circuit boards, at electrical connections or between electrical or electronic components. Whiskers, or needle-shaped growths from solder locations, usually burn through again, at low current levels of 10 mA for example, but until then the current that has flowed may already have resulted in component damage or malfunction.

An additional problem is that whiskers may not arise until after years of operation and their occurrence can only be poorly predicted.

SUMMARY OF THE INVENTION

Against the background of the prior art described, it is therefore an object of the present invention to provide a contact unit, particularly a solder pin, and a method for producing a contact unit wherein the contact pin is easy to produce and can withstand the temperatures encountered in modern soldering processes.

The contact unit in accordance with the preferred embodiment of the invention is designed in particular as a solder pin and comprises a body that has a metal core and a tin layer enclosing or surrounding the metal core. The tin layer is configured as a duplex layer and comprises a radially inner layer overlay of matte tin and a radially outer layer overlay of glossy tin.

The contact unit in accordance with the invention has many advantages. A substantial advantage of the contact unit in accordance with the invention is the use of the duplex layer provided around the metal core. This ensures that, in the interior of the tin layer designed as a duplex layer, the matte tin ensures even wetting of the solder pin, or of the contact unit respectively, even at high soldering temperatures, while the radially outer layer overlay of glossy tin surrounding the inner layer overlay of matte tin results in a smooth and mechanically compatible surface. Since the outer surface of glossy tin usually acts as the mechanical contact, the contact unit in accordance with the invention has a considerable advantage since good mechanical compatibility and good contactability are established.

The inner layer overlay of matte tin preferably has few or even no organic components that can lead to outgassing and thus to bubbling on the body of the contact unit when soldering the contact unit. The radially outer layer overlay of glossy tin on the other hand routinely has only one layer thickness of this nature so that bubbling does not occur when the contact unit is heated.

A further considerable advantage is that harmful whisker formation can be substantially reduced or even totally prevented by the duplex layer in accordance with the invention. This intrinsically surprising effect occurs even though whiskers are known to occur particularly on glossy tin layers, and here the duplex layer has an outer glossy tin layer. Whisker formation is largely prevented here by the structure in accordance with the invention, having an inner matte tin layer and an outer glossy tin layer.

Compared with the duplex layer in accordance with the invention, pure matte tin layers have the disadvantage of increased application of force when inserting and removing connectors since the surface roughness is greater. In addition, the visual surface quality of matte tin layers is inferior.

Thus, the invention provides a contact unit that allows both impressive mechanical properties and good electrical properties and, in addition, attractive surface quality.

An additional advantage of the invention results from preventing microperforations, microcraters, microcracks or microvoids, and of the potential resulting coalescence of such microvoids, MVC or microvoid coalescence. The coalescence of these microvoids can result in a limitation of function. With the duplex layer in accordance with the invention, such defects and perforations are prevented in a highly satisfactory manner so that the reliability and potential useful life of the contact unit in accordance with the invention increases.

The thickness of the layer overlay of matte tin preferably comes to between approximately 50 and 85 or 90% of the radial layer thickness of the tin layer. The thickness of the layer overlay of matte tin is particularly preferably between approximately ⅔ and ⅘ of the radial layer thickness of the tin layer. Furthermore, the thickness of the layer overlay of glossy tin is preferably between about 15 and 50% of the radial layer thickness of the tin layer. Particularly preferably, the radial layer thickness of the layer overlay of glossy tin is between approximately ⅕ and ⅓ of the radial layer thickness of the tin layer. Particularly preferably, the result is a ratio of the thicknesses of the layer overlay of glossy tin to matte tin of approximately 1:2.

It has been shown that a duplex layer with about ⅔ layer thickness of matte tin and about ⅓ layer thickness of glossy tin fulfils the desired mechanical and electrical properties. With a configuration of this type, the duplex layer is not destroyed either in the thermal separation process for producing a contact unit in accordance with the invention or in a reflow soldering process, for example. A contact unit of this type in accordance with the invention satisfies even severe demands.

Preferably there exists a layer thickness for the total duplex layer of between approximately 1 and 10 micrometers.

Preferably the thickness of the layer overlay of matte tin is approximately 2 to 4 micrometers, and in particularly preferred configurations can be about 2.5 micrometers. The radially outer layer overlay of glossy tin preferably has a layer thickness of approximately 1 to 2 micrometers and can be approximately 1.5 micrometers in particularly preferred configurations so that a radial layer thickness of the tin layer of between approximately 3 and 5 micrometers overall results.

It is preferred in all embodiments that the core be surrounded by an interim layer that contains nickel or consists of nickel. An interim layer of this type is applied in particular directly to the core, onto which layer in turn the duplex layer of matte tin and glossy tin is applied. The coating is preferably performed in successive galvanic processes. The nickel layer can be very thin. Layer thicknesses between 0.5 μm and 5 μm are preferred. In particular, the layer thickness of the duplex layer, including the interim layer of nickel or a nickel-bearing material, is less than approximately 10 μm.

In preferred refinements, the body comprises at least one pin tip that is configured in particular with a conical taper and is similarly surrounded by the duplex layer. In particular, the pin tip is preferably surrounded by the duplex layer, at least largely and in particular completely, in order to ensure good mechanical contactability and good solderability of the contact pin.

In all embodiments it is preferable that the body be manufactured in a thermal separation process wherein at least a pin tip tapering to a point results at one end in particular.

Manufacture of the contact unit by means of a thermal separation process is very advantageous since the thermal separation process is simple to perform, in addition to being fast and uncomplicated. The invention ensures that, in spite of the temperatures encountered, the duplex layer remains intact even on the pin tip so that separate recoating of the outer surface of the body obtained by a thermal separation process is not necessary.

In all embodiments it is possible and preferable that the core be designed in cross-section to be polygonal, rounded or round. In particular the body consists of a pre-measured piece of semi-finished wire galvanically coated with the duplex layer that is divided into specified lengths.

In all configurations and refinements of the invention, the layer overlay of glossy tin can comprise organic additives to smooth the surface.

The glossy tin layer preferably has a typical grain size of about 0.5 to 1.0 micrometer, while the matte tin used can have a grain size of typically about 3.0 micrometers. From this fact alone, the result is a clearly different level of smoothness for a pure matte tin surface than for a glossy tin surface. The outer glossy tin surface provides the desired mechanical property for the solder pin, or contact unit, while the layer of matte tin ensures solderability.

Bubbling during the reflow soldering process is prevented so that good mechanical properties are achieved by the smooth surface of the outer tin layer.

The method in accordance with the invention serves to produce a contact unit, specifically to produce a solder pin, and is performed using a semi-finished wire that is furnished initially with a radially inner layer overlay of matte tin and a subsequent radially outer layer overlay of glossy tin. An interim layer of nickel, for example, can be applied before the application of the layer overlay of matte tin. In a subsequent thermal separation process, a pre-measured piece of the semi-finished wire furnished with the duplex layer is cut off to form a solder pin, the body of which is surrounded by the duplex layer.

The method in accordance with the invention also has many advantages. One considerable advantage is that production is simplified, and supplementary galvanic coating of the outer surface of the solder pin can be omitted since the duplex layer applied at the normal temperatures of a reflow soldering process is preserved on the entire, or almost the entire, surface of the body, whereby good mechanical and electrical properties are achieved.

In a refinement of the method in accordance with the invention, the thickness of the layer overlay of matte tin and the thickness of the layer overlay of glossy tin are matched to one another in such a way that even the pin tip is largely enclosed by the duplex layer after the thermal separation process. The effect of this is that harmful bubbling does not occur.

To produce the contact units, or solder pins, a semi-finished wire is used, and a pre-measured piece of wire is detached as the wire is held at the specified location using clamping jaws;

the wire is heated at the clamping point specifically by means of a current-induced heating element integrated into the clamping jaws, whereupon by application of tension a specified body is detached.

Specifically, the wire is heated and softened by a pulse of electrical current. Surprisingly, it has turned out that in the subsequent separation process the duplex layer is completely, or almost completely, preserved.

Bubbles and dewetting of the surfaces are reliably prevented on a consistent basis so that homogenous and reproducible conditions exist at the pin tip and the remaining surface of the contact pins.

BRIEF DESCRIPTION OF THE DRAWINGS

Additional advantages and features of the present invention become clear from the embodiment that is explained hereinafter with reference to the appended Figures.

The drawings described herein are for illustrative purposes only of selected embodiments and not all possible implementations, and are not intended to limit the scope of the present disclosure.

FIGS. 1 and 2 show schematically an electrical contact pin 1 in accordance with the invention, designed as solder pin 2.

Corresponding reference numerals indicate corresponding parts throughout the several views of the drawings.

DETAILED DESCRIPTION OF THE PREFERRED EMBODIMENTS

Example embodiments will now be described more fully with reference to the accompanying drawings.

Figure 1:
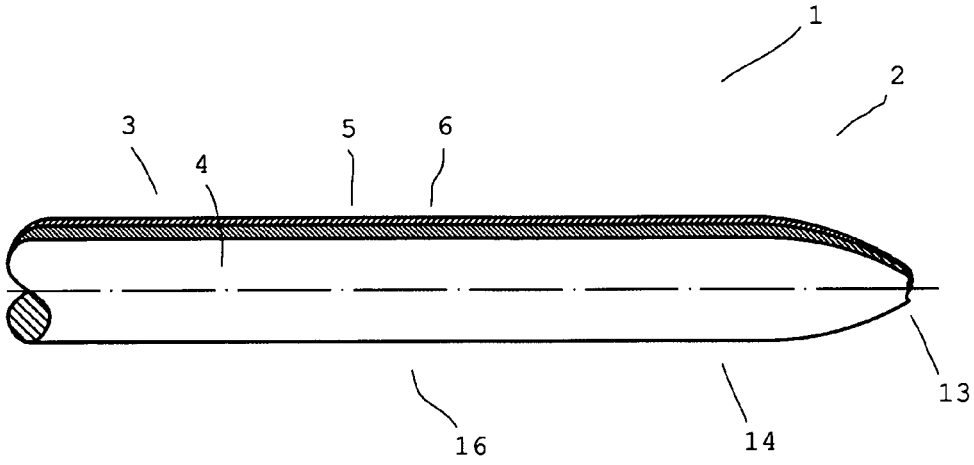
FIG. 1 shows a schematic, sectioned side view of an electrical solder pin in accordance with the invention.

The solder pin 2 depicted in FIG. 1 has a body 3 that comprises a metal core 4. The metal core 4 can, for example, be designed as wire and have a round, triangular or polygonal cross-section.

The semi-finished wire 14 has been galvanically coated with a tin layer 5. The tin layer 5 is designed as a duplex layer 6 that comprises a radially inner layer overlay 7 and a radially outer layer overlay 8.

The radially inner layer overlay 7 is a matte tin layer that has a greater surface roughness than the radially outer layer overlay 8 that consists of a glossy tin layer. The glossy tin layer 8 has good mechanical and electrical properties on account of its considerably lower surface roughness.

Coating of the metal core 4 can be carried out in one pass-through operation in which the entire length of a wire roll is furnished directly with the duplex layer 6. Following coating, the semi-finished wire 14 furnished with the tin layer 5 is specifically rolled up again and can be stored in this fashion to save space.

To produce the individual solder pins 2, the body 3 is selectively clamped and, at the later pin tip 13, the core 4 and the layer overlays 7 and 8 are specifically thermally heated by a current pulse such that, upon the application of tension, the core 4 is detached at the pin tip 13, resulting in a specific body 3.

Figure 2:
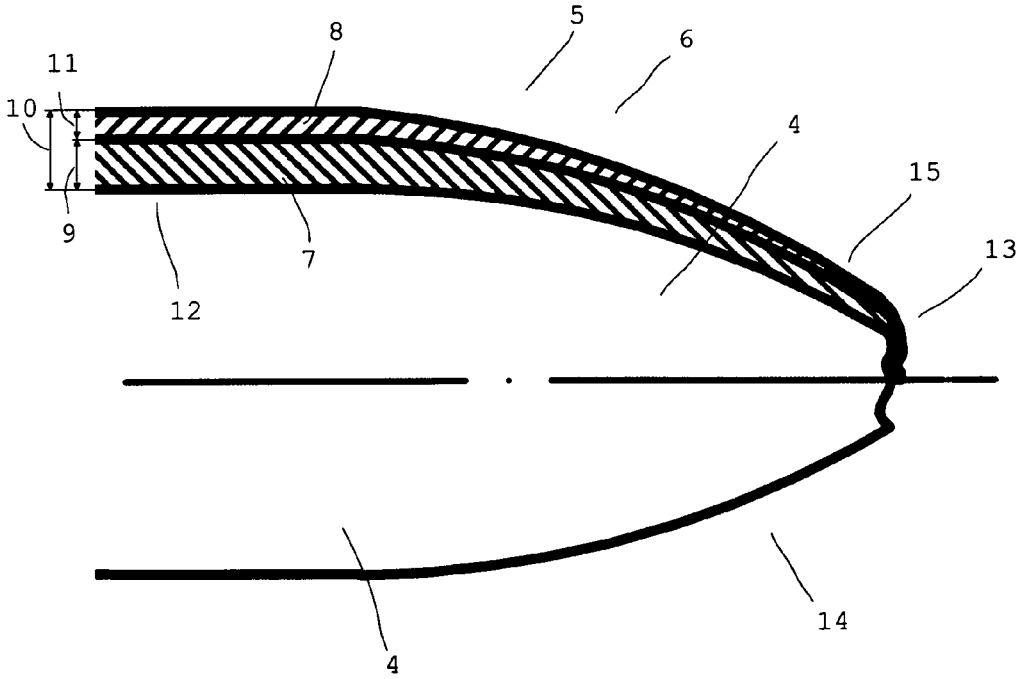
FIG. 2 shows the pin tip of the solder pin from FIG. 1 in an enlarged view.

The pin tip 13 is shown enlarged in FIG. 2. It is clearly recognizable that the layer thickness 9 of the radially inner layer overlay 7 is considerably greater than the layer thickness 11 of the radially outer layer overlay 8, wherein the ratio of layer overlay 8 to the thickness of layer overlay 7 here is approximately 1:2 in this embodiment.

A thin interim layer 12 can be provided directly on the core 4, consisting of nickel for example, and serving as a basis for the duplex layer 6. In a concrete configuration, the layer thickness of the interim layer 12 of nickel or a nickel-bearing material is about 2.4 μm, while the layer thickness of the layer overlay 7 of matte tin is about 3.2 μm, and the layer thickness of the layer overlay 8 of glossy tin is about 1.65 μm.

As can be seen in particular from the enlarged view from FIG. 2, the duplex layer 6 is present over the entire surface 15 of the body 3 up to the pin tip 13, ensuring good soldering conditions and mechanical properties for the solder pin 2.

A simple production method is made available as a result of the invention, with which solder pins 2 can be produced that have good mechanical and electrical properties and with which reliable soldering is practicable.

The contact units 1 additionally have a premium visual surface quality. Perforations, microvoids, microcracks and similar defects that are unattractive in the enlarged view and that can substantially detract from function and durability as the result of coalescence, are prevented. Such defects are also prevented by the considerably reduced percentage of organic materials in the duplex layer and particularly in the matte tin layer without sacrificing the advantages of the glossy tin layer.

Needle-like extensions and similar defects, such as the growth of whiskers in particular, can also be largely or even entirely prevented, although a smooth surface with electrically good contact is provided with an outer glossy tin layer.

Compared with the production methods known from the prior art, additionally required galvanic coating steps are eliminated so that contact units, or solder pins, can be produced economically and efficiently using the present invention.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

What is claimed:

1. A contact unit including a solder pin comprising; a solder pin body having a metal core and a tin layer surrounding the metal core, the tin layer, as a duplex layer, has a radially inner layer overlay of matte tin and a radially outer layer overlay of glossy tin;

wherein a pin tip of the solder pin is produced in a thermal separation process.

2. Contact unit from claim 1, wherein the thickness of the layer overlay of matte tin amounts to between 50 and 90% of the radial layer thickness of the tin layer.

3. Contact unit from claim 1, wherein the thickness of the layer overlay of glossy tin amounts to between 15 and 50% of the radial layer thickness of the tin layer.

4. Contact unit from claim 1, wherein a layer thickness of the duplex layer amounts to between about 3 and 10 μm.

5. Contact unit from claim 1, wherein an interim layer of nickel, or consisting of nickel, is provided on the core.

6. Contact unit from claim 1, wherein the body comprises at least one pin tip that is similarly surrounded by the duplex layer.

7. Contact unit from claim 1, wherein the core is designed polygonal, rounded or round in cross-section.

8. Contact unit from claim 1, wherein the layer overlay of glossy tin has organic additives to smooth the surface.

9. Method for producing a solder pin in which a semi-finished wire is coated with a tin layer as a duplex layer, wherein the duplex layer has a radially inner layer overlay of matte tin and a radially outer layer overlay of glossy tin, wherein a pre-measured piece of the semi-finished wire furnished with the duplex layer is detached in a subsequent thermal separation process to form a pin tip, the body of which is enclosed by the duplex layer.

10. Method from claim 9, wherein the thickness of the layer overlay of matte tin and the thickness of the layer overlay of glossy tin are matched to each other such that the pin tip is largely enclosed by the duplex layer after the thermal separation process.

11. Method from claim 9, wherein the pre-measured piece of the semi-finished wire is held by clamping jaws.

12. A contact unit comprising a contact pin body having a metal core and a duplex tin layer surrounding the metal core, the duplex tin layer having a radially inner layer overlay of matte tin and a radially outer layer overlay of glossy tin:

wherein a pin tip of the contact unit is produced in a thermal separation process.

13. The contact unit of claim 12, wherein the thickness of the overlay of matte tin is between 50 and 90% of the thickness of the duplex tin layer.

14. The contact unit of claim 13, wherein the thickness of the overlay of glossy tin is between 15 and 50% of the thickness of the duplex tin layer.

15. The contact unit of claim 14 wherein the thickness of the duplex tin layer is between about 3 and 10 μm.

16. The contact unit of claim 15 which further comprises an interim layer containing nickel between the core and the duplex tin layer.

* * * * *